US005844366A

United States Patent [19]

Ochiai

[11] Patent Number: 5,844,366

[45] **Date of Patent: *Dec. 1, 1998**

[54] MAGNETRON COILED FEEDTHROUGH LC FILTER

[75] Inventor: Hiroshi Ochiai, Kawauchi-gun, Japan

[73] Assignee: Matsushita Electronics Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 795,364

[22] Filed: Feb. 4, 1997

Related U.S. Application Data

[63] Continuation of Ser. No. 496,171, Jun. 28, 1995, abandoned.

[30] Foreign Application Priority Data

Aug. 9, 1994 [JP] Japan ..... 6-187493

[51] Int. Cl.[6] ..... H01J 25/50

[52] U.S. Cl. ..... 315/39.51; 333/182

[58] Field of Search ..... 315/39.51; 333/181, 333/175, 182, 184, 185, 12

[56] References Cited

U.S. PATENT DOCUMENTS

| | | | |
|---|---|---|---|
| 3,638,155 | 1/1972 | Combs | 336/69 |
| 3,732,459 | 5/1973 | Oguro et al. | 315/39.51 |
| 3,859,558 | 1/1975 | Harada et al. | 315/39.51 |
| 4,131,824 | 12/1978 | Nakai et al. | 333/181 |
| 4,926,111 | 5/1990 | Lungu | 336/69 X |

FOREIGN PATENT DOCUMENTS

| | | | |
|---|---|---|---|
| 336771 | 10/1989 | European Pat. Off. . | |
| 375655 | 6/1990 | European Pat. Off. . | |
| 52-67565 | 6/1977 | Japan | 315/39.51 |
| 55-77370 | 6/1980 | Japan | 333/185 |
| 60-38910 | 2/1985 | Japan | 333/181 |
| 4167711 | 6/1992 | Japan | 333/175 |
| 5-166674 | 7/1993 | Japan . | |
| 6-112752 | 4/1994 | Japan . | |
| 6-14460 | 4/1994 | Japan . | |

*Primary Examiner*—Robert Pascal
*Assistant Examiner*—Justin P. Bettendorf
*Attorney, Agent, or Firm*—Pillsbury Madison & Sutro LLP

[57] ABSTRACT

An LC filter member has at least one coil-shaped conductor wire, an insulating layer formed on the outer surface of the coil-shaped wire and a conductive layer formed on the outer surface of the insulating layer. One end of the coil-shaped conductor wire is substantially electrically connected to a cathode terminal, and the other end of the coil-shaped conductor wire is substantially electrically connected to a high frequency electric supply. The conductive layer is grounded.

10 Claims, 10 Drawing Sheets

Number of turns of the coil-shaped part of the present invention or number of turns of the choke coil of the prior art

MAGNETRON COILED FEEDTHROUGH LC FILTER

This is a continuation of application Ser. No. 08/496,171, filed on Jun. 28, 1995, which was abandoned upon the filing hereof.

FIELD OF THE INVENTION AND RELATED ART STATEMENT

1. Field of the Invention

This invention relates to a microwave apparatus which is suitable for use in a microwave oven or the like.

2. Description of the Related Art

A microwave apparatus uses a magnetron driven by a high frequency electric supply, and works at a fundamental wave, for example 2,450 MHz. The microwave apparatus must prevent undesirable external or outward leakage of high frequency radiation including the fundamental wave from a resonant cavity to a cathode of the magnetron.

FIG. 10 is a sectional bottom view taken on a plane which is close to the bottom of a conventional microwave apparatus. As shown in FIG. 10, a conventional microwave apparatus 100 comprises a conductive shielding metal case 101 for preventing leakage of the high frequency radiation to the surrounding space. An LC filter circuit 102 is contained by the metal case for preventing leakage of the high frequency radiation through power supply cord. The shielding metal case 101 is mounted underneath a bottom part of the microwave apparatus 100 so as to cover the below-mentioned choke coils 105*a,* 105*b* and cathode terminals 103*a,* 103*b* disposed on a stem insulator 104 for preventing the high frequency radiation from escaping.

The LC filter circuit 102 comprises choke coils 105*a,* 105*b* and a feed-through-type capacitor 106 attached to a side wall of the shielding metal case 101. The choke coils 105*a,* 105*b* are made of an annealed copper wire, and connected between the cathode terminal 103*a,* 103*b* and central conductors 108*a,* 108*b* of the feed-through-type capacitor 106 by plasma arc welding, respectively. That is, one end of the choke coil 105*a* is connected to the cathode terminal 103*a,* and the other end of the choke coil 105*a* is connected to one end of the central conductor 108*a.* Similarly, one end of the choke coil 105*b* is connected to the cathode terminal 103*b,* and the other end of the choke coil 105*b* is connected to one end of the central conductor 108*b.*

The feed-through-type capacitor 106 comprises pipe shaped insulating cases 107*a,* 107*b,* the central conductors 108*a,* 108*b,* a cylindrical shaped ceramic dielectric element 109, connecting members 110*a,* 110*b,* and a grounding plate 111. The insulating cases 107*a,* 107*b* are made of an insulating resin such as PBT (poly butylene telephthalate). The insulating cases 107*a,* 107*b* are filled with an insulating resin 113 such as an epoxy resin. Thereby, the central conductors 108*a,* 108*b,* the ceramic dielectric element 109, the connecting members 110*a,* 110*b,* and the grounding plate 111 are isolated from each other, and held at the respective predetermined positions in the insulating cases 107*a,* 107*b*

The central conductors 108*a,* 108*b* are insulator-coated electrical wire such as a silicone tube wire (i.e. silicone-sheathed conductor wire), and the other ends of the central conductors 108*a,* 108*b* are connected to a high frequency electric supply (not shown) via fasten-tabs 112*a,* 112*b,* respectively.

The ceramic dielectric element 109 has two through holes for passing the central conductors 108*a,* 108*b.* In the axial direction of the ceramic dielectric element 109, electrodes 109*a,* 109*b* are disposed on one surface of the ceramic dielectric element 109, and an electrode 109*c* is disposed on the other surface of the ceramic dielectric element 109 so as to face to the electrodes 109*a,* 109*b* across the ceramic dielectric element 109.

The electrodes 109*a,* 109*b* are connected to the central conductors 108*a,* 108*b* by the connecting members 110*a,* 110*b,* respectively. The electrode 109*c* is connected to the shielding metal case 101 by the grounding plate 111 to be fixed to the side wall of the shielding metal case 101. Thereby, the electrode 109*c* is grounded.

However, in the conventional microwave apparatus 100, the LC filter circuit 102 is composed of the choke coils 105*a,* 105*b* and the feed-through-type capacitor 106 which has a large number of component parts. Therefore, the LC filter circuit 102 becomes complicated, and the size of the microwave apparatus must be inevitably large and the cost of the microwave apparatus is high.

OBJECT AND SUMMARY OF THE INVENTION

The object of the present invention is to provide a microwave apparatus that can solve the aforementioned problems.

In order to achieve the above object, a microwave apparatus in accordance with the present invention comprises:

a microwave generating source, an LC filter for preventing external leakage of high frequency radiation from the microwave generating source, the LC filter having at least one coil-shaped conductor wire, an insulating layer formed on at least a part of the outer surface of the coil-shaped conductor wire, and a conductive layer formed on at least a part of the outer surface of the insulating layer.

According to the above-mentioned configuration of the present invention, when the high frequency electric power is supplied from the power source for driving the magnetron to the cathode terminals, a predetermined inductance appears at the at least one coil-shaped conductor, and a predetermined capacitance also appears in the insulating layer. Therefore, the LC filter consisting of the coiled special conductor works as an LC filter circuit without the use of the prior art feed-through-type capacitor. Thereby, it is possible to simplify construction of the LC filter, and to reduce the size of the microwave apparatus. As a result, the cost of the microwave apparatus can be reduced.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENT

Hereafter, preferred embodiments of a microwave apparatus of the present invention are described with reference to the accompanying drawings.

FIRST EMBODIMENT

Figure 1:
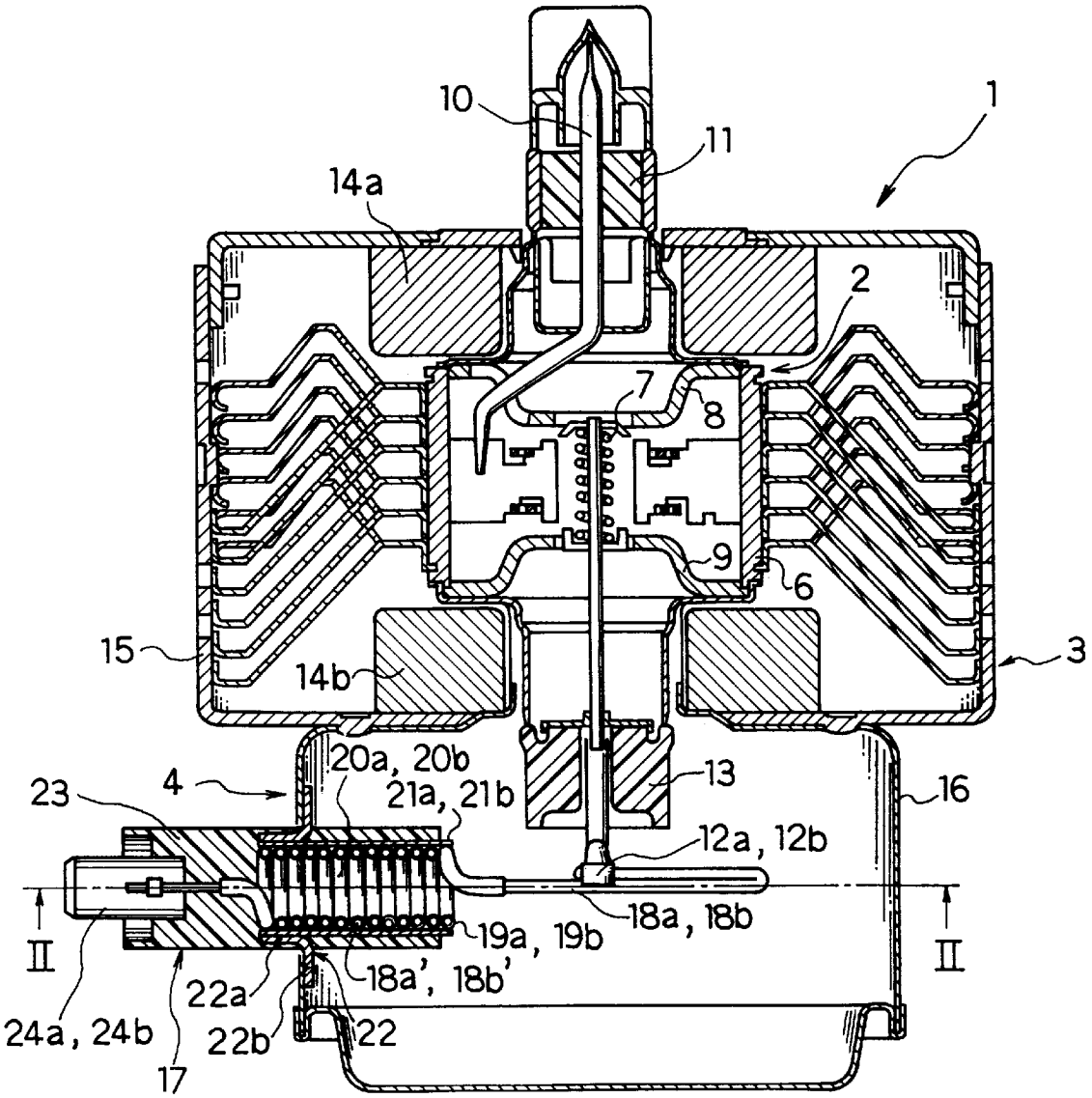
FIG. 1 is a cross sectional view showing a microwave apparatus of a first embodiment of the present invention.

FIG. 1 is a cross sectional view showing a microwave apparatus of a first embodiment of the present invention.

As shown in FIG. 1, a microwave apparatus 1 comprises a magnetron part 2, an external magnetic circuit part 3 for exciting the magnetron part 2, an antileakage part 4 for preventing external leakage of high frequency radiation including a fundamental wave (for example 2,450 MHz), and a high frequency electric supply part 5 (FIG. 2) for driving the magnetron part 2.

The magnetron part 2 has an anode cylinder 6, a coil-shaped cathode 7, a pair of frustum-shaped magnetic pole pieces 8, 9, a microwave radiation antenna 10, and a pair of cathode terminals 12*a*, 12*b*. The anode cylinder 6 is made of a metal such as copper. The coil-shaped cathode 7 is made of metal such as thoriated-tungsten, and disposed coaxially with and in the anode cylinder 6. The pair of the frustum-shaped magnetic pole pieces 8, 9 are made of a magnetic material such as iron, and disposed above and under the coil-shaped cathode 7, respectively. One end of the microwave radiation antenna 10 is disposed in a resonant cavity formed in the inner space of the anode cylinder 6. The other end of the microwave radiation antenna 10 is disposed supported at the top part of the microwave apparatus 1 by a ceramic insulator 11. The pair of the cathode terminals 12*a*, 12*b* are disposed on a stem insulator 13 in parallel with each other in a vertical (or normal) direction to the sheet of FIG. 1.

The external magnetic circuit part 3 has a pair of cylindrical shaped permanent magnets 14*a*, 14*b* disposed above and below the frustum-shaped magnetic pole pieces 8, 9, respectively, and a frame-shaped magnetic yoke 15.

The antileakage part 4 has a conductive shielding metal case 16 mounted underneath the bottom part of the frame-shaped magnetic yoke 15, and the LC filter 17 is attached to the side wall of the shielding metal case 16.

Figure 2:
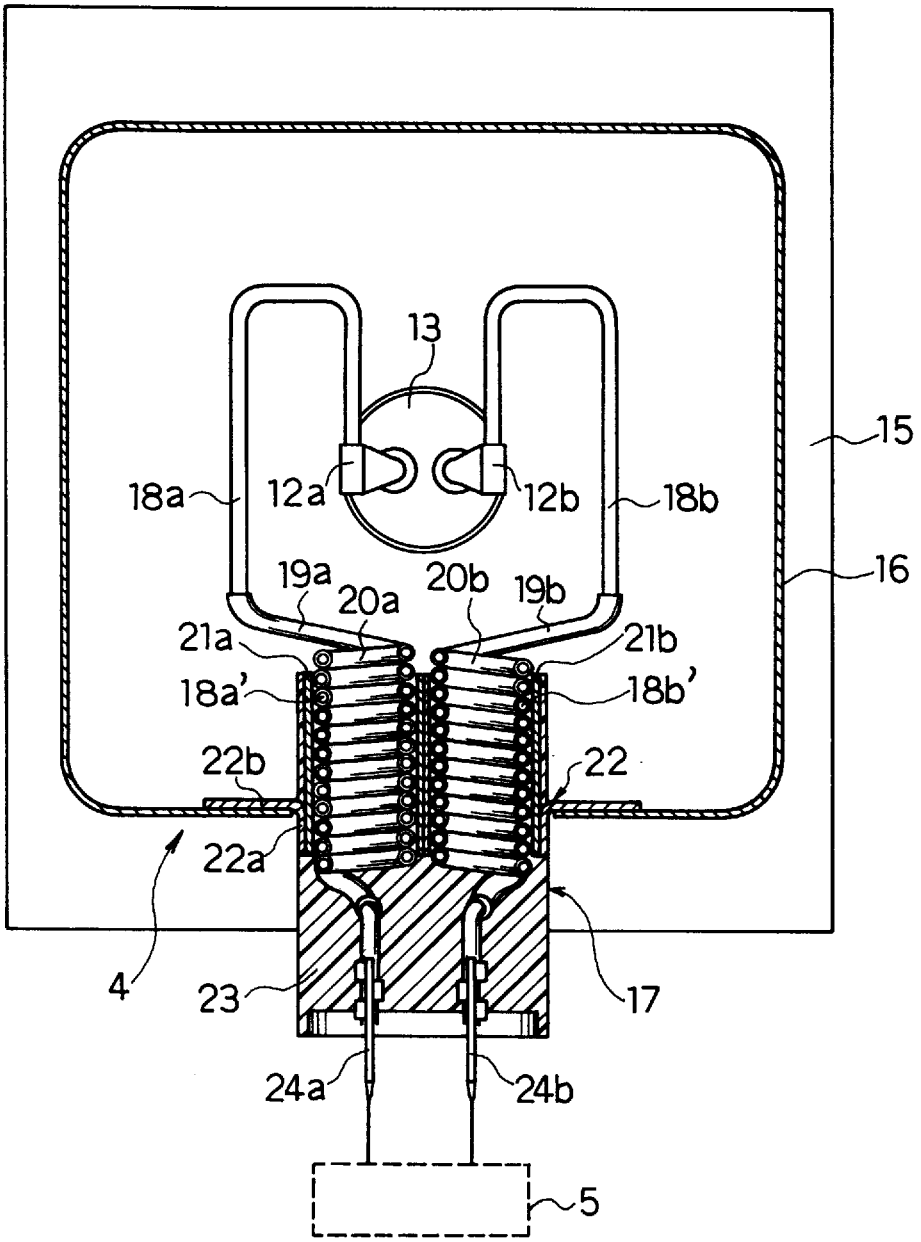
FIG. 2 is a partial cross sectional view, which is taken on line II—II of FIG. 1, showing a bottom part of the microwave apparatus of the first embodiment of the present invention.
Figure 3A:
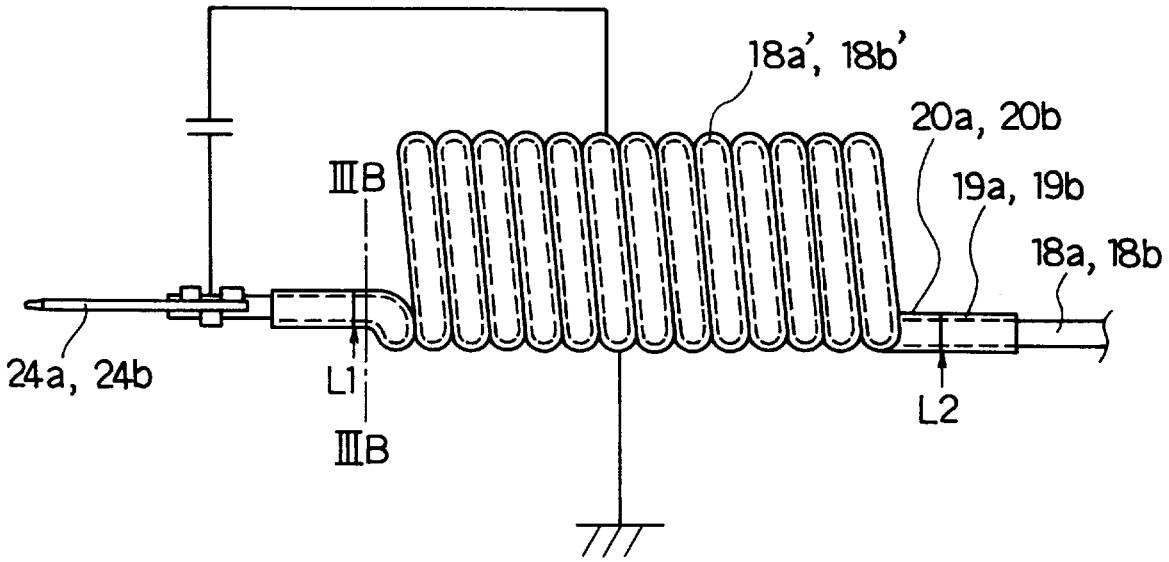
FIG. 3A is an enlarged explanatory view showing an LC filter of the microwave apparatus of the first embodiment of the present invention.
Figure 3B:
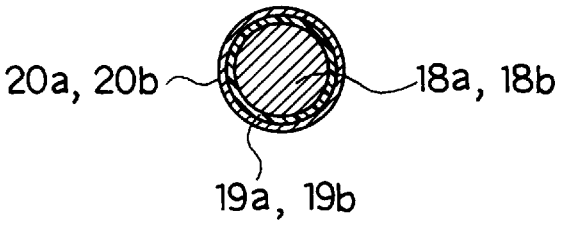
FIG. 3B is a cross sectional view, which is taken on line IIIB—IIIB of FIG. 3A, showing the LC filter of the microwave apparatus of the first embodiment of the present invention.

A configuration of the LC filter 17 will be elucidated with reference to FIG. 2, FIG. 3A and FIG. 3B. FIG. 2 is a partial cross sectional view, which is taken on line II—II of FIG. 1, showing a bottom part of the microwave apparatus of the first embodiment of the present invention. FIG. 3A is an enlarged explanatory view showing the LC filter of the microwave apparatus of the first embodiment of the present invention. FIG. 3B is a cross sectional view, which is taken on line IIIB—IIIB of FIG. 3A, showing the LC filter of the microwave apparatus of the first embodiment of the present invention. In FIG. 2, sectional illustrations of the below-mentioned conductive layers 20*a*, 20*b* of the LC filter 17 are omitted for the sake of simplicity of drawings.

As shown by FIG. 1 through FIG. 3A, the LC filter 17 comprises a pair of conductors 18*a*, 18*b*, a pair of insulating layers 19*a*, 19*b*, a pair of conductive layers 20*a*, 20*b*, a pair of pipe-shaped conductive members 21*a*, 21*b*, a grounding plate 22 and a cylindrical insulating case 23.

The pair of the conductors 18*a*, 18*b* are made of metal wires such as annealed copper wires and aluminum wires, and have coil-shaped parts 18*a*', 18*b*' respectively. Each of these coil-shaped parts 18*a*', 18*b*' is formed by circularly winding the metal wire, which has a diameter between 1 mm and 2 mm, a predetermined number of turns. Each diameter of the coil-shaped parts 18*a*', 18*b*' is preferably between 5 mm and 10 mm, and each length of the coil-shaped parts 18*a*', 18*b*' is preferably between 15 mm and 25 mm. The conductors 18*a*, 18*b* are connected between the high frequency electric supply part 5 (shown by a broken line of FIG. 2) and the cathode terminals 12*a*, 12*b*. That is, one end of the conductor 18*a* is connected to the cathode terminal 12*a* by caulking or plasma arc welding, and the other end of the conductor 18*a* is connected to one terminal of the high frequency electric supply part 5 via a fasten-tab 24*a*. Similarly, one end of the conductor 18*b* is connected to the cathode terminal 12*b* by caulking or plasma arc welding, and the other end of the conductor 18*b* is connected to the other terminal of the high frequency electric supply part 5 via a fasten-tab 24*b*.

Apart from the aforementioned explanation, wherein each of the coil-shaped parts 18*a*', 18*b*' is formed by circularly winding the metal wire a predetermined number of turns, an alternative construction may be such that each of the coil-shaped parts 18*a*', 18*b*' is formed by winding the metal wire into one of an oval, a rectangle and a spiral shape a predetermined number of turns. Furthermore, apart from connection through pair of the conductors 18*a*, 18*b* having the coil-shaped parts 18*a*', 18*b*' respectively, an alternative construction may be such that only one conductor having the corresponding coil-shaped part is used for connection of one of the cathode terminals and a non-coiled conductor is used for connection of the other of the cathode terminals.

The pair of the insulating layers 19*a,* 19*b* are made of a resin such as a polyamide resin or a silicone resin, which is heat resistant and will withstand voltage. These insulating layers are formed on the outer surfaces of the conductors 18*a,* 18*b* by dip-coating so as to coat at least a part of the coil-shaped parts 18*a*', 18*b*' is coated, respectively. Each thickness of the insulating layers 19*a,* 19*b* is preferably between 30 $\mu$m and 500 $\mu$m.

The pair of the conductive layers 20*a,* 20*b* are made of a conductive material such as silver paste, nickel or copper, and are formed on the outer surfaces of the insulating layers 19*a,* 19*b* by metal spraying or by dip-coating so that at least a part of the insulating layers 19*a,* 19*b,* are respectively covered. The conductive layers 20*a,* 20*b* are isolated from the conductors 18*a,* 18*b* by the insulating layers 19*a,* 19*b* and the end parts of the conductors 18*a,* 18*b* are not covered by the conductive layers 20*a,* 20*b,* respectively. That is, each of the conductive layers 20*a,* 20*b* is formed on the outer surfaces of the insulating layers 19*a,* 19*b* only between the positions shown by arrows "L1" and "L2" of FIG. 3A. Each thickness of the conductive layers 20*a,* 20*b* is preferably between 20 $\mu$m and 30 $\mu$m.

Apart from the aforementioned explanation, wherein the conductive layers 20*a,* 20*b* are formed on the outer surfaces of the insulating layers 19*a,* 19*b,* respectively, an alternative construction may be such that the conductive layers 20*a,* 20*b* are formed on the outer surfaces of the insulating layers 19*a,* 19*b* so that only one of the outer side and the inner side of the coil-shaped parts 18*a*', 18*b*' are coated, respectively.

The pair of the pipe-shaped conductive members 21*a,* 21*b* are made of a conductive material such as zinc, aluminum or iron, and fixed around the outer surfaces of the conductive layers 20*a,* 20*b* with an adhesive or by soldering, respectively.

The grounding plate 22 consists of a cylindrical part 22 and a flange part 22*b,* and is made of a conductive material such as aluminum, zinc or iron. The cylindrical part 22*a* is mounted around the outer surfaces of the pipe-shaped conductive members 21*a,* 21*b.* The flange part 22*b* is fixed to the side wall of the shielding metal case 16. Thereby, each of the conductive layers 20*a,* 20*b* is grounded via the pipe-shaped conductive members 21*a,* 21*b* and the grounding plate 22.

The cylindrical insulting case 23 is made of an insulating resin such as an epoxy resin. As shown in FIG. 2, the cylindrical insulating case 23 is formed to be solid by molding in a mold containing the coil-shaped parts 18*a*', 18*b*'. However, the inside spaces of the coil-shaped parts 18*a*', 18*b*' are not filled with the insulating resin leaving the inside space hollow. In the cylindrical insulating case 23, the conductors 18*a,* 18*b,* the conductive layers 20*a,* 20*b,* the grounding plate 22 and the fasten-tabs 24*a,* 24*b* are isolated from each other.

Apart from the above-mentioned explanation, wherein the cylindrical insulating case 23 is formed to be solid, an alternative construction may be for the cylindrical insulating case 23 consist of two components, namely, an external casing made of an insulating resin such as PBT (Poly butylene telephthalate) or PET (Poly ethylene telephthalate) and an insulating resin such as an epoxy resin. In such way, other components are disposed in the external casing, and the insulating resin is poured into the external casing in order to isolate these components from each other and hold these components at respective predetermined positions in the external casing.

By the above-mentioned configuration, in the antileakage part 4, predetermined capacitances appear between the shielding metal case 16 and the fasten-tabs 24*a,* 24*b* as shown in FIG. 3A.

In this first embodiment, when the high frequency electric power is supplied to the magnetron part 2, the LC filter 17 operates as follows:

(1) Predetermined inductances appear at the coil-shaped parts 18*a*', 18*b*' of the conductors 18*a,* 18*b.*

(2) Predetermined capacitances appear in the insulating layers 19*a,* 19*b* sandwiched between the coil-shaped parts 18*a*', 18*b*' of the conductors 18*a,* 18*b* and the grounded conductive layers 20*a,* 20*b,* respectively.

Thus, the LC filter 17 serve as an LC filter circuit where required inductances and capacitances appear without using a feed-through-type capacitor of the prior art. Therefore, it is possible to simplify construction of the LC filter circuit.

Furthermore, it is not necessary to connect the feed-through-type capacitor to choke coils like the prior art in the shielding metal case 16. Therefore, it is possible for the size of the microwave apparatus 1 to be reduced. As a result, the cost of the microwave apparatus 1 can also be reduced.

Moreover, it is possible to easily perform a connecting process between the cathode terminals 12*a,* 12*b* and the conductors 18*a,* 18*b,* respectively. For this reason, any members such as choke coils of the conventional microwave apparatus are not disposed near the cathode terminals 12*a,* 12*b.*

Since the conductive layers 20*a,* 20*b* are connected to the shielding metal case 16 via the pipe-shaped conductive members 21*a,* 21*b* and the grounding plate 22, a superior radiation of heat generated at the conductors 18*a,* 18*b* and the conductive layers 20*a,* 20*b* is achieved.

Since the inside spaces of the coil-shaped parts 18*a*', 18*b*' are not filled with the insulating resin, it is possible to substantially stop the conductive layers 20*a,* 20*b* from pealing out of the above-mentioned insulating resin due to differences of their thermal capacity and coefficient of thermal expansion. As a result, it is possible to prevent the coil-shaped parts 18*a*', 18*b*' from breaking, and improve the reliability of the microwave apparatus.

In the construction of the LC filter 17, when annealed copper wire is used for the conductors 18*a,* 18*b,* it is possible to reduce the electrical loss during the operation of the microwave apparatus.

Furthermore, when a polyamide resin having a high dielectric constant is used for the insulating layers 19*a,* 19*b,* a large capacitance per area is obtainable, and the insulating layers 19*a,* 19*b* can be easily formed on the outer surfaces of the conductors 18*a,* 18*b,* respectively. Moreover, when silver paste is further used for the conductive layers 20*a,* 20*b,* the conductive layers 20*a,* 20*b* can be smoothly formed on the respective insulating layers 19*a,* 19*b* without falling thereon.

Figure 4A:
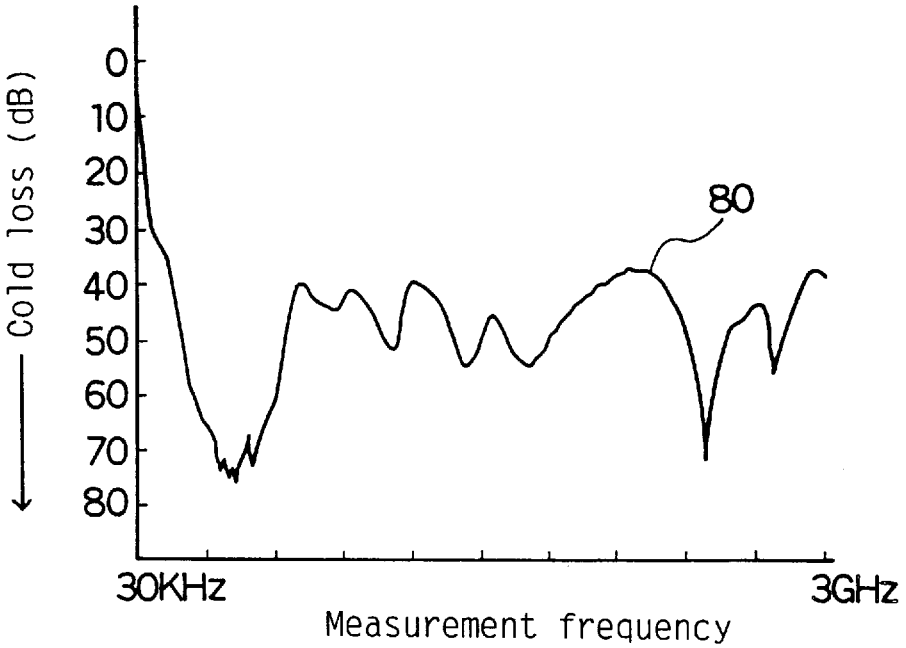
FIG. 4A is a graph showing cold loss obtained from a first test for the microwave apparatus of the present invention, wherein the abscissa is graduated with measurement frequency and the ordinate is graduated with the cold loss.
Figure 4B:
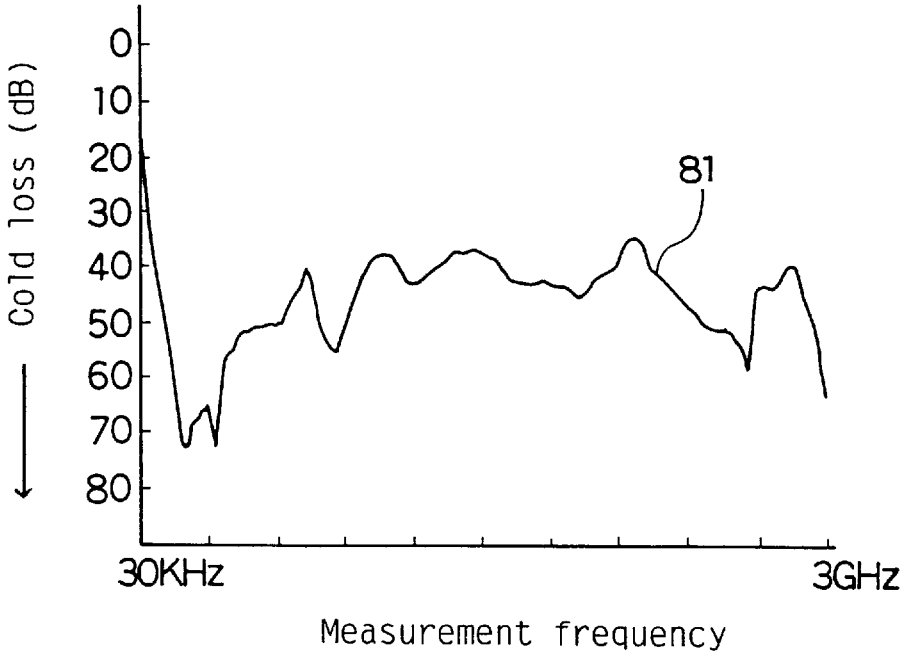
FIG. 4B is the graph showing the cold loss obtained from the first test for a conventional microwave apparatus, wherein the abscissa is graduated with measurement frequency and the ordinate is graduated with the cold loss.

A first test result for confirming effects of the present invention will be discussed with reference to FIG. 4A and FIG. 4B. FIG. 4A is a graph showing cold loss obtained from a first test for the microwave apparatus of the present invention, wherein the abscissa is graduated with measurement frequency and the ordinate is graduated with the cold loss. FIG. 4B is the graph showing the cold loss obtained from the first test for a conventional microwave apparatus, wherein the abscissa is graduated with measurement frequency and the ordinate is graduated with the cold loss.

In these first tests, cold attenuation characteristics of the LC filter 17 are obtained by measuring cold losses at the predetermined high frequency band (for example, 30 KHz - - - 3 GHz). The cold attenuation characteristics are characteristics for attenuation of the high frequency radiation at cold conditions of the microwave apparatus (i.e. non-oscillation condition of the magnetron part 2). The cold losses are measured by a known measuring device connected between the cathode terminals 12*a,* 12*b* and the fasten-tabs 24*a,* 24*b*.

Figure 10:
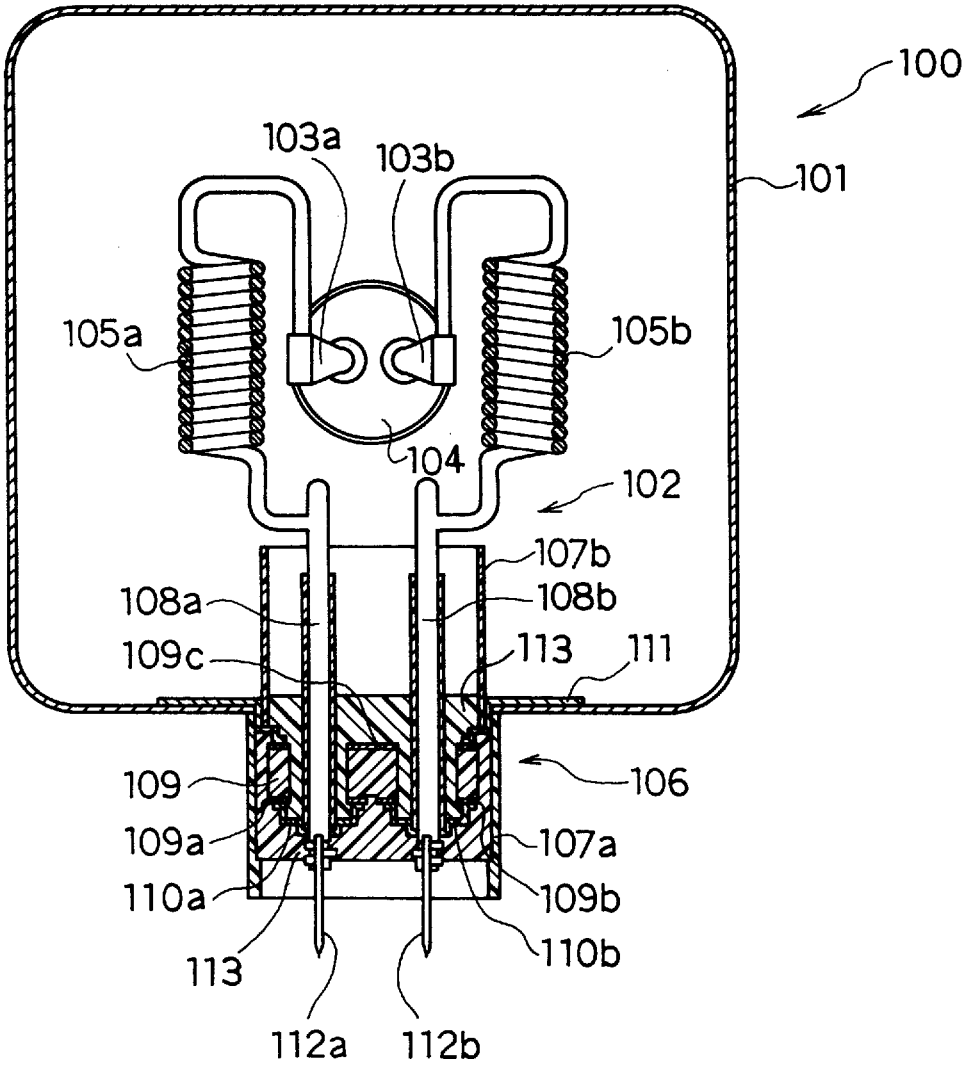
FIG. 10 (Prior Art)
FIG. 10 is a sectional bottom view taken on a plane which is close to the bottom of the conventional microwave apparatus.

Furthermore, in order to confirm the technical advantages of the present invention, the cold attenuation characteristic of the LC filter 17 of the microwave apparatus 1 shown in FIG. 1 was compared with that of the LC filter circuit 102 of the conventional microwave apparatus 100 shown in FIG. 10.

In the first test, the materials and sizes of the LC filter 17 shown in FIG. 2 are as follows:

- the conductors 18*a,* 18*b* were made from "annealed copper wire" (coated with the below-mentioned insulating layers 19*a,* 19*b,* respectively);
- each diameter of the conductors 18*a,* 18*b* was 1.4 mm (including the below-mentioned thickness of the insulating layers 19*a,* 19*b,* respectively);
- the insulating layers 19*a,* 19*b* were made from "polyamide resin";
- each thickness of the insulating layers 19*a,* 19*b* was 30 μm;
- the conductive layers 20*a,* 20*b* were made from "silver paste";
- each thickness of the conductive layers 20*a,* 20*b* was 20 μm;
- each diameter of the coil-shaped parts 18*a*', 18*b*' was 6.4 mm; and
- each length of the coil-shaped parts 18*a*', 18*b*' was 21 mm.

By the above-mentioned construction, the capacitances of the LC filter 17 was about 500 pF.

In order to easily and accurately compare with the above-mentioned LC filter 17, the choke coils 105*a,* 105*b* of the conventional LC filter circuit 102 shown in FIG. 10 were made in the same configuration as the above-mentioned coil-shaped parts 18*a*', 18*b*'. That is, the choke coils 105*a,* 105*b* were formed using the same annealed copper wire having a diameter of 1.4 mm, coated by the polyamide resin having a thickness of 30 μm, each diameter of the choke coils 105*a,* 105*b* is 6.4 mm and each length of the choke coils 105*a,* 105*b* was 21 mm. Furthermore, the capacitance of the feed-through-type capacitor 106 is selected to about 500 pF.

As shown in FIG. 4A and FIG. 4B, the cold losses shown by a solid curve 80 are mostly larger than those shown by a solid curve 81 in the high frequency band of 30 KHz - - - 3 GHz. That is, the cold attenuation characteristic of the LC filter 17 is improved from that of the LC filter circuit 102. Thereby, it is confirmed that a practical LC filter circuit can be composed of the LC filter 17.

Figure 5:
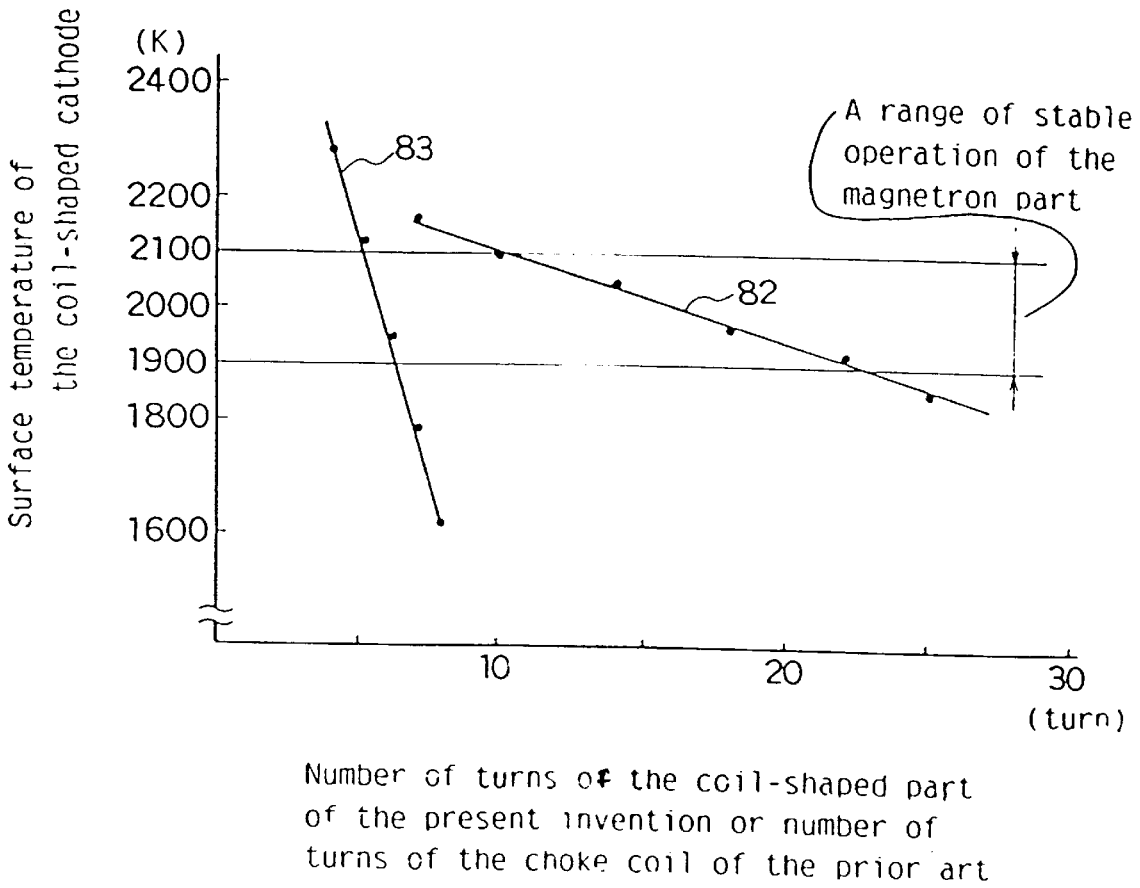
FIG. 5 is a graph showing relations between the surface temperature of the coil-shaped cathode and the number of turns of the coil-shaped part of the present invention or the number of turns of the choke coil of the prior art, wherein the abscissa is graduated with the number of turns of the coil-shaped part of the present invention or the number of turns of the choke coil of the prior art and the ordinate is graduated with the surface temperature of the coil-shaped cathode.

A second test result for confirming effects of the present invention will be discussed with reference to FIG. 5. FIG. 5 is a graph showing relations between the surface temperature of the coil-shaped cathode and the number of turns of the coil-shaped part of the present invention or the number of turns of the choke coil of the prior art. The abscissa is graduated with the number of turns of the coil-shaped part of the present invention or the number of turns of the choke coil of the prior art, and the ordinate is graduated with the surface temperature of the coil-shaped cathode.

In this second test, the influence of the number of turns of the coil-shaped parts 18*a*', 18*b*' to surface temperature of the coil-shaped cathode 7 (FIG. 1) (hereinafter referred to as a "turns influence") is determined by studying the relationship between the surface temperature of the coil-shaped cathode 7 (FIG. 1) and the number of turns of the coil-shaped parts 18*a*', 18*b*'. The surface temperature of the coil-shaped cathode 7 can be measured by a known infrared sensor.

In this second test, the test conditions were changed from those of the first test as follows:

(1) Each length of the coil-shaped parts 18*a*', 18*b*' and the choke coils 105*a,* 105*b* was varied; and each number of turns of the coil-shaped part 18*a*', 18*b*' and the choke coil 105*a,* 105*b* was varied.

(2) The microwave apparatus 1 and the conventional microwave apparatus 100 were driven by an inverter electric supply at high frequency of 25 KHz.

In FIG. 5, a solid line 82 shows a test result of the microwave apparatus 1, and a solid line 83 shows a test result of the conventional microwave apparatus 100.

As shown in FIG. 5, when the surface temperature of the coil-shaped cathode 7 is a range of 1,900 K. and 2,100 K., there is a drastic effect that the magnetron part 2 operates stably.

As shown by the solid line 82, in the microwave apparatus 1, the number of turns to give a stable operation of the magnetron part 2 in the range between 1,900 K. and 2,100 K. is in a range between about 10 turns and about 23 turns. On the other hand, as shown by the solid line 83, in the conventional microwave apparatus 100, the number of turns to give a stable operation of the magnetron in the range between 1,900 K. and 2,100 K. is in a range between about 5 turns and about 6 turns. That is, the number of turns which give a stable operation in the present invention is about 13 (=(23−10)/(6−5)) times as large as that of the prior art. As a result, in the present invention, it is possible to reduce the turns influence, and to easily adjust the microwave apparatus.

Figure 6:
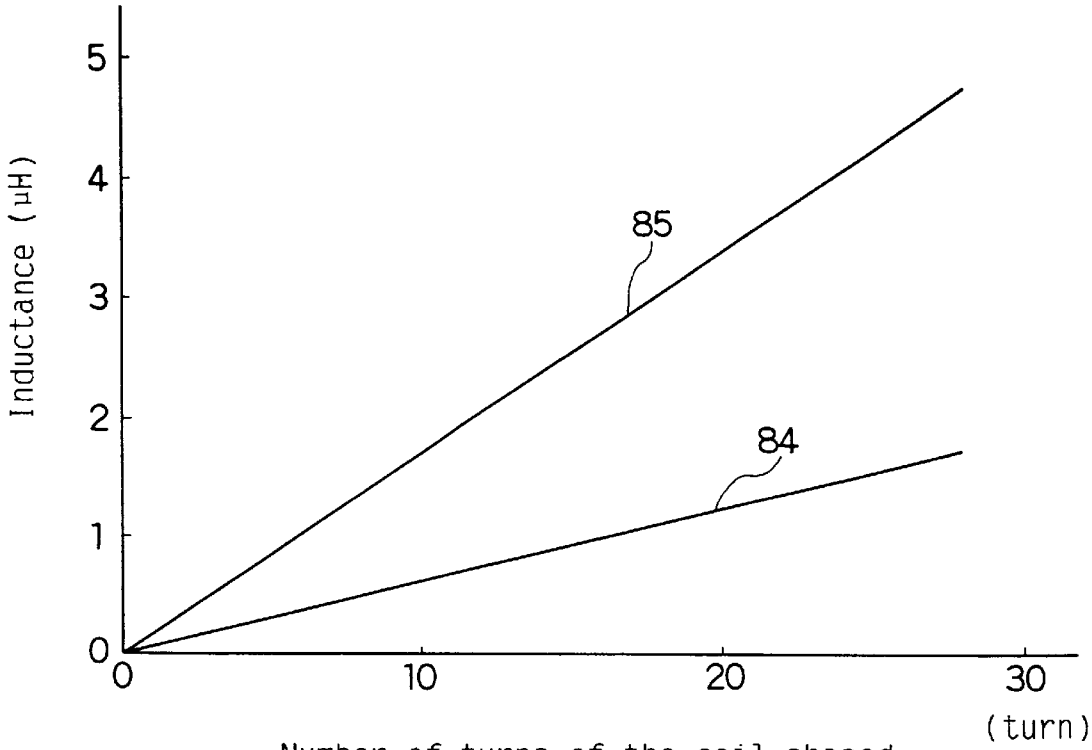
FIG. 6 is a graph showing relations between the inductance and the number of turns of the coil-shaped part of the present invention or the number of turns of the choke coil of the prior art, wherein the abscissa is graduated with the number of turns of the coil-shaped part of the present invention or the number of turns of the choke coil of the prior art and the ordinate is graduated with the inductance.

The main reason of this result will be discussed with reference to FIG. 6. FIG. 6 is a graph showing the relationship between the inductance and the number of turns of the coil-shaped part of the present invention or the number of turns of the choke coil of the prior art. The abscissa is graduated with the number of turns of the coil-shaped part of the present invention or the number of turns of the choke coil of the prior art, and the ordinate is graduated with the inductance.

In FIG. 6, a solid line 84 shows a measured result of the inductance to the number of turns of the coil-shaped part 18*a*', 18*b*', and a solid line 85 shows a measured result of the inductance to the number of turns of the choke coils 105*a,* 105*b*. As shown by the solid lines 84 and 85, an increasing rate of the inductance to the number of turns of the embodiment of the present invention is under about ⅓ of the prior art. Therefore, as has been shown above, in the microwave apparatus 1 of the present embodiment, it is possible to reduce the turns influence in comparison with that of the conventional microwave apparatus 100.

SECOND EMBODIMENT

Figure 7:
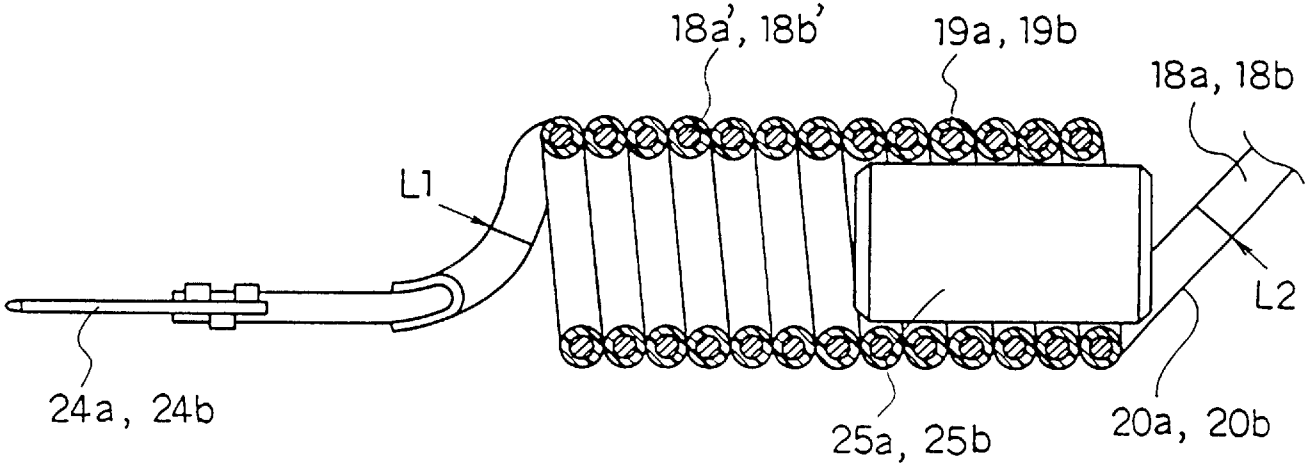
FIG. 7 is an enlarged explanatory view showing an LC filter of a second embodiment of the microwave apparatus of the present invention.

FIG. 7 is an enlarged explanatory view showing an LC filter of a second embodiment of the microwave apparatus of the present invention. In this second embodiment, the same components and parts as those of the first embodiment are designated by the same numerals, and corresponding descriptions similarly apply. Therefore, the descriptions will be made mainly on the modified parts from the first embodiment.

The gist of the second embodiment is to insert members, for example, bar-shaped ferrite cores 25*a,* 25*b* having a property of absorbing the high frequency radiation into the inside spaces of the coil-shaped parts 18*a*', 18*b*', respectively.

Thereby, it is possible to reduce the external leakage of the high frequency radiation further than with the first embodiment.

THIRD EMBODIMENT

Figure 8:
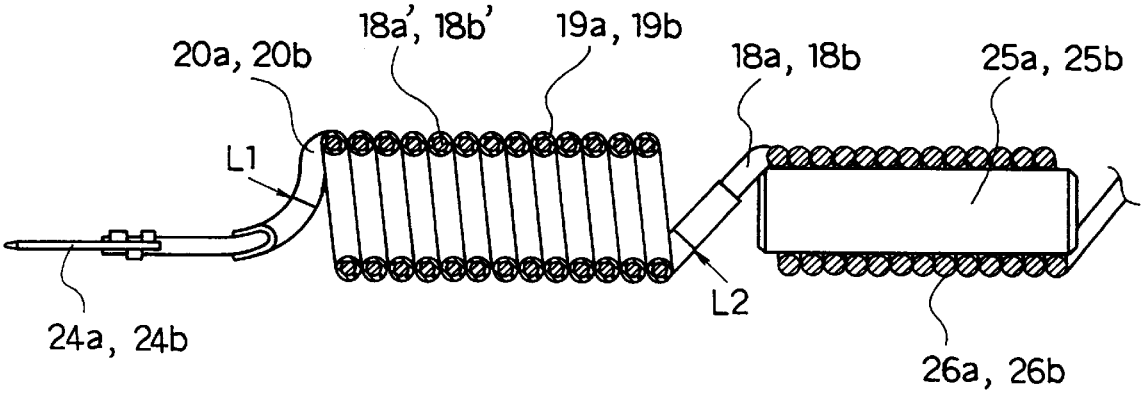
FIG. 8 is an enlarged explanatory view showing an LC filter of a third embodiment of the microwave apparatus of the present invention.

FIG. 8 is an enlarged explanatory view showing an LC filter of a third embodiment of the microwave apparatus of the present invention. In this third embodiment, the same components and parts as those of the first embodiment are designated by the same numerals, and corresponding descriptions similarly apply. Therefore, the descriptions will be made mainly on the modified parts from the first embodiment.

The gist of the third embodiment is to connect the choke cathode terminals 12*a,* 12*b* (FIG. 2) and the conductors 18*a,* 18*b* of the LC filter 17, respectively.

Thereby, it is possible to reduce the external leakage of the high frequency radiation in comparison with the first embodiment.

FOURTH EMBODIMENT

Figure 9:
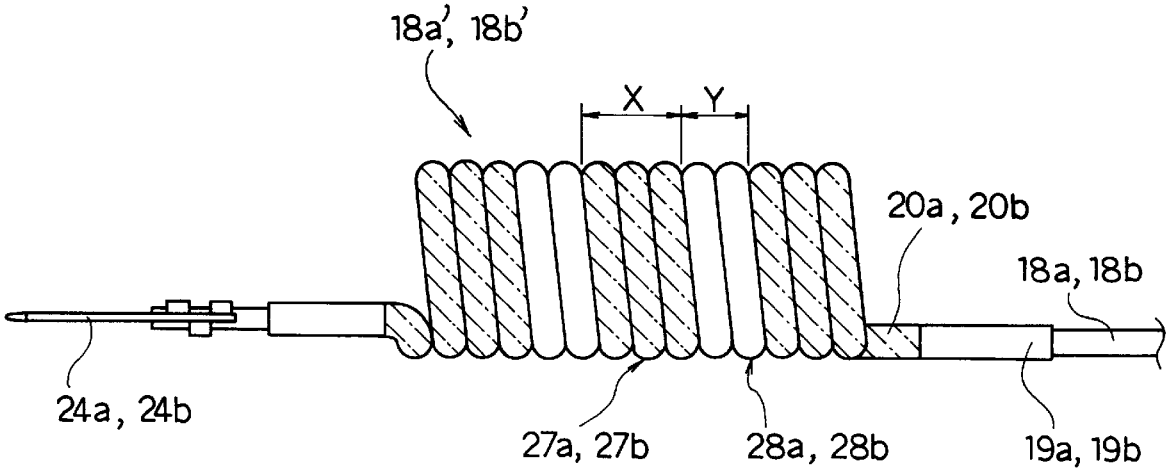
FIG. 9 is an enlarged explanatory view showing an LC filter of a fourth embodiment of the microwave apparatus of the present invention.

FIG. 9 is an enlarged explanatory view showing an LC filter of a fourth embodiment of the microwave apparatus of the present invention. In this fourth embodiment, the same components and parts as those of the first embodiment are designated by the same numerals, and corresponding descriptions similarly apply. Therefore, the descriptions will be made mainly on the modified parts from the first embodiment.

The gist of this fourth embodiment is to alternately form plural coating parts 27*a,* 27*b* (for example, 3 pieces) of the conductive layers 20*a,* 20*b* and plural non-coating parts 28*a,* 28*b* (for example, 2 pieces) of the conductive layers 20*a,* 20*b* in the longitudinal directions of the coil-shaped parts 18*a*', 18*b*', respectively. That is, as shown in FIG. 9, the conductive layers 20*a,* 20*b* are formed on the outer surfaces of the insulating layers 19*a,* 19*b* intermittently in a manner that stripes are formed on the outer surfaces of the insulating layers 19*a,* 19*b* by alternating appearance of the coating parts 27*a,* 27*b* shown by chain lines and the non-coating parts 28*a,* 28*b.*

In this fourth embodiment, some parts of the inductances and the capacitances appear at each of the coating parts 27*a,* 27*b,* and the rest of the inductances appear at each of the non-coating parts 28*a,* 28*b.* Thereby, the predetermined capacitances are divided into three components appearing at the respective coating parts 27*a,* 27*b,* and also the predetermined inductances are divided into five components appearing at the respective coating parts 27*a,* 27*b* and the respective non-coating parts 28*a,* 28*b.* According to the inventor's experimental study, this divided inductance and divided capacitance type configuration makes it possible to shorten the lengths of the coil-shaped parts 18*a*', 18*b*' in comparison with the first embodiment.

Also the experiments showed that in order to further shorten the lengths of the coil-shaped parts 18*a*', 18*b*', a range of the coating parts 27*a,* 27*b* shown by "X" becomes larger than, preferably about two times as large as, a range of non-coating parts 28*a,* 28*b* shown by "Y".

Apart from the aforementioned explanation, wherein the plural coating parts 27*a,* 27*b* and the plural non-coating parts 28*a,* 28*b* are formed alternately in longitudinal directions of the coil-shaped parts 18*a*', 18*b*', respectively, an alternative construction may be to alternatively form plural coating parts 27*a,* 27*b* and plural non-coating parts 28*a,* 28*b* to thereby form stripes which are parallel with the axes of the coil-shaped parts 18*a*', 18*b*', respectively. Furthermore, the plural coating parts 27*a,* 27*b* and the plural non-coating parts 28*a,* 28*b* may be formed alternately in an oblique manner with respect to the axes of coil-shaped parts 18*a*', 18*b*', respectively, so that each of the plural coating parts 27*a,* 27*b* and each of the plural non-coating parts 28*a,* 28*b* is formed in a spiral shape.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A microwave apparatus, comprising:

a microwave generating source, and

LC filter means for preventing external leakage of high frequency radiation from said microwave generating source, said LC filter means having at least one coil shaped conductor wire, an insulating layer formed on at least a part of an outer surface of said coil-shaped conductor wire, and a conductive layer formed on at least a part of an outer surface of said insulating layer, such that the conductor wire, the insulating layer and the conductive layer are all coil shaped, wherein one end of said coil-shaped conductor wire is substantially electrically connected to a cathode terminal, an other end of said coil-shaped conductor wire is connected to a power source for driving said microwave generating source, a pipe-shaped conductive member is fixed around an outer surface of said conductive layer and connected to a shielding metal case and grounded, and a cylindrical insulating case formed by molding contains said pipe-shaped conductive member, said cylindrical insulating case being molded so as to contain said one end of said coil-shaped conductor wire molded therein.

2. A microwave apparatus in accordance with claim 1, wherein a member having a property of absorbing high frequency radiation is disposed in an inside space formed by said coil-shaped conductor wire.

3. A microwave apparatus in accordance with claim 1, wherein said conductive layer is intermittently formed on the outer surface of said insulating layer to form a stripe on said outer surface of said insulating layer of said conductive layer.

4. A microwave apparatus in accordance with claim 3, wherein said conductive layer is intermittently formed on the outer surface of said insulating layer intermittently in a longitudinal direction of said coil-shaped conductor wire, and a width of said conductive layer is larger than a width of a non existence region of said conductive layer.

5. A microwave apparatus in accordance with claim 3, wherein said microwave generating source has a coil-shaped cathode having a surface temperature in a range of about 1900° to 2100° in operation.

6. A microwave apparatus in accordance with claim 1, wherein a thickness of said insulating layer is between 30 $\mu$m and 500 $\mu$m.

7. A microwave apparatus in accordance with claim 1, wherein said microwave generating source has a coil-shaped cathode having a surface temperature in a range of about 1900° to 2100° in operation.

8. A microwave apparatus in accordance with claim 1, wherein said coil-shaped conductor wire comprises annealed copper wire, said insulating layer comprises polyamide resin, and said conductive layer comprises a silver paste.

9. A microwave apparatus comprising:

a microwave generating source, and

LC filter means for preventing external leakage of high frequency radiation from said microwave generating source, said LC filter means having at least one coil shaped conductor wire, an insulating layer formed on at least a part of an outer surface of said coil-shaped conductor wire, and a conductive layer formed on at least a part of an outer surface of said insulating layer, such that the conductor wire, the insulating layer and the conductive layer are all coil shaped, wherein one end of said coil-shaped conductor wire is electrically connected to a cathode terminal, an other end of said coil-shaped conductor wire is connected to a power source for driving said microwave generating source, a pipe-shaped conductive member is fixed around an outer surface of said conductive layer and connected to a shielding metal case and grounded and a cylindrical insulating case formed by molding contains said pipe-shaped conductive member, said cylindrical insulating case being molded so as to contain said one end of said coil-shaped conductor wire molded therein, wherein a choke coil is connected between said cathode terminal and said coil-shaped conductor wire, and a member having a property of absorbing high frequency radiation is inserted into an inside space formed by said choke coil.

10. A microwave apparatus in accordance with claim 9, wherein said microwave generating source has a coil-shaped cathode having a surface temperature in a range of about 1900° to 2100° in operation.

* * * * *